US007057350B2

(12) United States Patent
Lambrechts et al.

(10) Patent No.: US 7,057,350 B2
(45) Date of Patent: Jun. 6, 2006

(54) METAL HALIDE LAMP WITH IMPROVED LUMEN VALUE MAINTENANCE

(75) Inventors: Stefaan M. Lambrechts, Beverly, MA (US); Nobuyoshi Takeuchi, Osaka (JP); Jakob Maya, Brookline, MA (US)

(73) Assignees: Matsushita Electric Industrial Co. Ltd., Osaka (JP); Matsushita Electric Works, Ltd., Osaka (JP)

( * ) Notice: Subject to any disclaimer, the term of this patent is extended or adjusted under 35 U.S.C. 154(b) by 206 days.

(21) Appl. No.: 10/839,804

(22) Filed: May 5, 2004

(65) Prior Publication Data

US 2005/0248279 A1 Nov. 10, 2005

(51) Int. Cl.
*H01J 17/20* (2006.01)

(52) U.S. Cl. ..... 313/640; 313/637

(58) Field of Classification Search ..... 313/490, 313/573, 574, 620, 637–640
See application file for complete search history.

(56) References Cited

U.S. PATENT DOCUMENTS 5,751,111 A 5/1998 Stoffels et al.
5,973,453 A 10/1999 Van Vliet et al.
6,137,230 A 10/2000 Born et al.
6,147,453 A 11/2000 Geijtenbeek et al.
6,300,729 B1 10/2001 Keijser et al.
6,356,016 B1 3/2002 Suijker et al.
6,362,569 B1 3/2002 Wijenberg et al.
6,362,571 B1 3/2002 Suijker et al.
6,404,129 B1 6/2002 Hendricx et al.
6,525,476 B1 2/2003 Geijtenbeek et al.
2005/0052139 A1* 3/2005 Anami et al. ..... 316/620

* cited by examiner

*Primary Examiner*—Vip Patel
(74) *Attorney, Agent, or Firm*—Kinney & Lange, P.A.

(57) ABSTRACT

An arc discharge metal halide lamp having a discharge chamber having visible light permeable walls bounding a discharge region supported electrodes in a discharge region spaced apart by a distance $L_e$ with an average interior diameter equal to D so they have a selected ratio with D exceeding a minimum value. Ionizable materials are provided in this chamber involving a noble gas, one or more halides, and mercury in an amount sufficiently small so as to result in a relatively low maximum voltage drop between the electrodes during lamp operation for a lamp dissipation sufficient to have the chamber wall loading exceed a minimum value or so as to maintain chamber luminosity above a minimum value for a selected operational duration.

19 Claims, 8 Drawing Sheets

METAL HALIDE LAMP WITH IMPROVED LUMEN VALUE MAINTENANCE

BACKGROUND OF THE INVENTION

This invention relates to high intensity arc discharge lamps and more particularly to high intensity arc discharge metal halide lamps having high efficacy.

Due to the ever-increasing need for energy conserving lighting systems that are used for interior and exterior lighting, lamps with increasing lamp efficacy are being developed for general lighting applications. Thus, for instance, arc discharge metal halide lamps are being more and more widely used for interior and exterior lighting. Such lamps are well known and include a light-transmissive arc discharge chamber sealed about an enclosed pair of spaced apart electrodes, and typically further contain suitable active materials such as an inert starting gas and one or more ionizable metals or metal halides in specified molar ratios, or both. They can be relatively low power lamps operated in standard alternating current light sockets at the usual 120 Volts rms potential with a ballast circuit, either magnetic or electronic, to provide a starting voltage and current limiting during subsequent operation.

These lamps typically have a ceramic material arc discharge chamber that usually contains quantities of metal halides such as cerium iodide ($CeI_3$) and sodium iodide (NaI), or praseodymium iodide ($PrI_3$) and NaI, or other rare earth halides such as dysprosium iodide ($DyI_3$), holmium iodide ($HoI_3$), and thulium iodide ($TmI_3$), and thallium iodide (T1I), as well as mercury to provide an adequate voltage drop or loading between the electrodes, and the inert starting gas. Keeping the lamp operating voltage below 110V rms results in relatively safe operation of the lamp and its ceramic arc discharge chamber. Such lamps can have an efficacy as high as 105 LPW at 250 W with a Color Rendering Index (CRI or Ra) higher than 60, with Correlated Color Temperature (CCT) between 3000 K and 6000 K at 250 W.

Of course, to further save electric energy in lighting by using more efficient lamps, high intensity arc discharge metal halide lamps with even higher lamp efficacies are needed and lamps which maintain well their luminous output over the operational duration thereof. The lamp efficacy is affected by the shape of the arc discharge chamber. If the ratio between the distance separating the electrodes in the chamber to the diameter of the chamber is too small, the relative abundance of Na between the arc and the chamber walls leads to a lot of absorption of generated light radiation by such Na due to its absorption lines near the peak values of visible light. On the other hand, if the ratio between the distance separating the electrodes in the chamber to the diameter of the chamber is too great such as being greater than five, initiating an arc discharge in the arc discharge chamber is difficult because of the relatively large breakdown distance between the electrodes. In addition, such lamps perform relatively poorly when oriented vertically during operation in exhibiting severe colors segregation as the different buoyancies of the lamp content constituents cause them to segregate themselves from one another to a considerable degree along the arc length.

Another problem with such metal halide lamps is the gradual reduction of the light output over the lamp operational duration due to the reduced light transmission through the walls of the arc discharge chamber. The darkening of the chamber wall is mainly attributable to sputtering of the electrode tungsten material during the starting of light emission in the chamber of the lamp, and to the evaporation of the electrode tungsten material in that chamber during subsequent lamp operation. In many instances, such coating of the arc discharge chamber walls by tungsten not only results in poor lamp output light lumen value maintenance but also to the premature failure of the lamp.

That such objectionable coating of the arc discharge chamber walls does not occur more quickly and completely than it typically does is generally thought to be due to a regenerative tungsten halide transport cycle phenomenon occurring in the chamber in which the deposited tungsten metal on the wall is returned to the electrodes thereby tending to keep the chamber walls clean. In this cycle, the tungsten material deposited on the chamber walls is thought to combine there with iodine from the ionizable constituents provided in the chamber to form tungsten iodide which then evaporates from the chamber wall to thereafter impinge on the electrodes. There, the tungsten iodide disassociates there with the iodine evaporating to thereby leave the tungsten deposited on the electrodes. An efficient halogen cycle of this sort results in excellent lamp light output lumen value maintenance and a long operational duration for the lamp.

One condition known for an efficient halogen cycle is the presence of a small amount of oxygen in the discharge chamber when the lamp is being operated. Thus, a metal halide lamp has been used with oxygen dispensers containing tungsten oxide ($WO_2$) and calcium oxide (CaO) to avoid arc discharge chamber tungsten coating and to extend lamp life. A small amount of free oxygen is released at a controlled rate into the chamber to aid in maintaining the halogen cycle. Success requires that the release of free oxygen be controlled. When too small an amount of oxygen is released, the halogen cycle will not operate as well resulting in early coating of the chamber walls. If, on the other hand, too much oxygen is released, the tungsten electrodes suffer extensive corrosion resulting in a short lamp operational duration due to electrode failure. Further alternatives include providing oxygen in the form of oxytrihalides such as niobium oxytriiodide ($NbOI_3$) or mercury oxide (HgO) or molecular oxygen or compounds containing oxygen to the chamber constituents. Metal oxyhalides, particularly tungsten oxyhalides, such as $WOI_2$, $WO_2Br_2$ and $WOBr_2$, will be formed during the operation of the lamp. However, such additions add expense to the manufacture of the lamp. Thus, there is a desire for a lamp that provides good efficacy with the output light lumen value well maintained while being operable by currently used ballast circuits.

BRIEF SUMMARY OF THE INVENTION

The present invention provides an arc discharge metal halide lamp for use in selected lighting fixtures comprising a discharge chamber having visible light permeable walls of a selected shape bounding a discharge region through which walls a pair of electrodes are supported in the discharge region and which are spaced apart from one another by a distance $L_e$. These walls about the discharge region have an average interior diameter over $L_e$ that is equal to D so they are related to have $L_e/D<2.75$ with D exceeding 2.0 mm. Ionizable materials are provided in this chamber discharge region comprising a noble gas, a metal halide and mercury in an amount sufficiently small so as to result in a voltage drop between the electrodes during lamp operation that is less than 110 V rms at a selected value of electrical power dissipation in the lamp such that wall loading of the discharge chamber during operation equals or exceeds 33

W/cm$^2$, or so that the lamp can be operated at selected values of electrical power dissipation therein that result in wall loadings of the discharge chamber during operation sufficient to maintain output luminosity of the discharge chamber after 12,000 hours of lamp operation at ninety percent or more of that output luminosity the discharge chamber provided during lamp operation at 100 hours of lamp operation. The walls of the discharge chamber comprise a metal oxide material and are approximately 0.8 mm thick.

DETAILED DESCRIPTION

Figure 1:
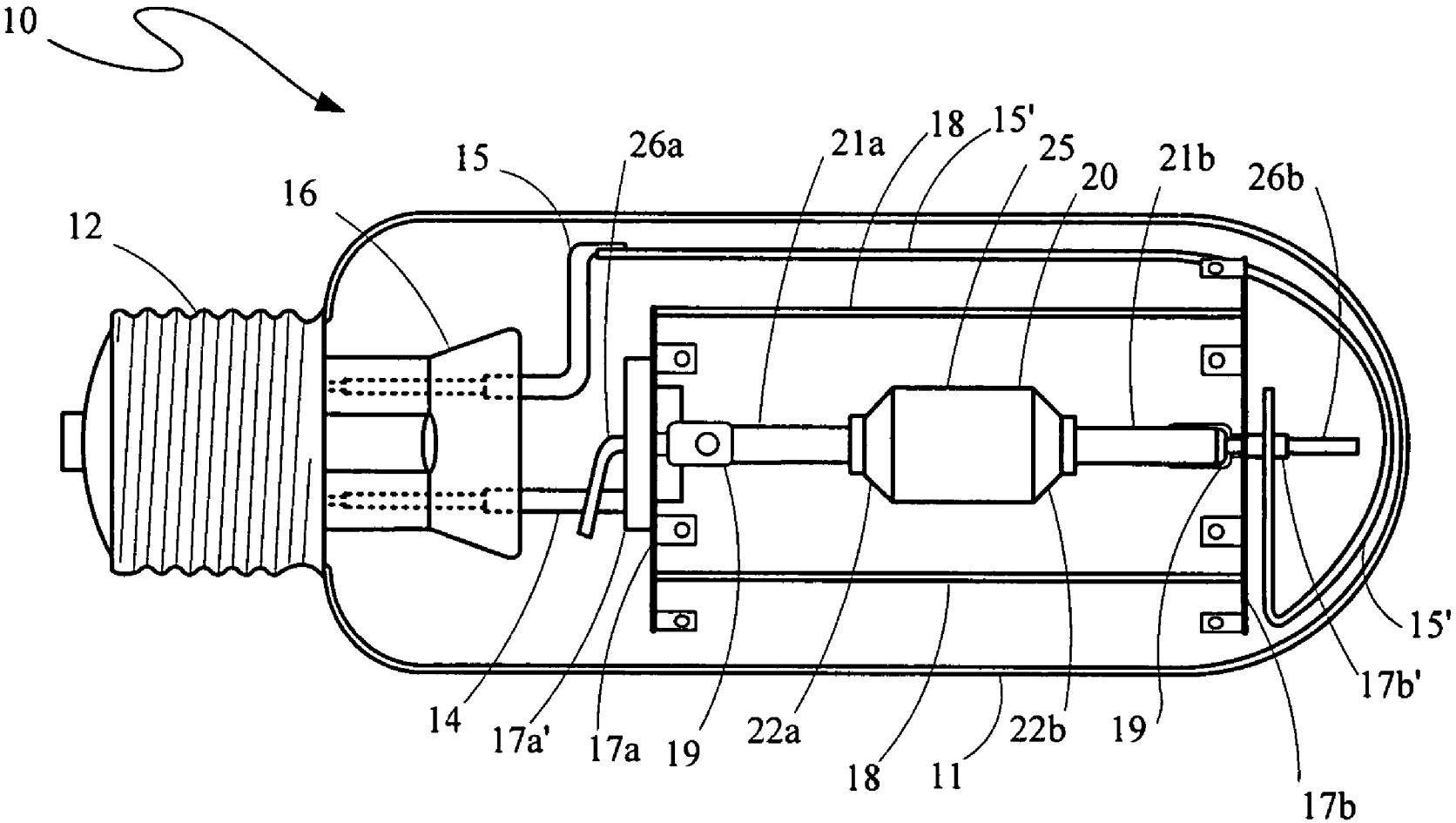
FIG. 1 is a side view, partially in cross section, of an arc discharge metal halide lamp of the present invention having a configuration of a ceramic arc discharge chamber therein.

Referring to FIG. 1, an arc discharge metal halide lamp, 10, is shown in a partial cross section view having a bulbous borosilicate glass envelope, 11, partially cut away in this view, fitted into a conventional Edison-type metal base, 12. Lead-in electrode wires, 14 and 15, and the extension, 15', of wire 15, are formed of nickel or soft steel each extend from a corresponding one of the two electrically isolated electrode metal portions in base 12 parallely through and past a borosilicate glass flare, 16, positioned at the location of base 12 and extending into the interior of envelope 11 along the axis of the major length extent of that envelope. Electrical access wires 14 and 15 extend initially on either side of, and in a direction parallel to, the envelope length axis past the far end of flare 16 relative to base 12 to have portions thereof located further into the interior of envelope 11.

A remaining portion of access wire 14 in the interior of envelope 11 extends to, and partially supports, a support plate, 17*a*, formed of nickel plated steel, through a ceramic insulator, 17*a*'. Insulator 17*a*' is approximately centered with respect to plate 17*a* in extending therethrough to be positioned on both sides thereof. A further support plate, 17*b*, also formed of nickel plated steel and having a turned up center tab, 17*b*', to leave an opening therethrough at the center thereof, is used with support plate 17*a* to support and capture a shroud, 18, formed as an optically transparent, truncated cylindrical shell of borosilicate glass to limit gaseous flows in the interior thereof so as to maintain relatively constant temperatures therein. Support plates 17*a* and 17*b* each have tabs at the periphery thereof bent perpendicular thereto so as to parallel the envelope length axis with the more interior tabs maintaining the position of shroud 18 with respect to support plates 17*a* and 17*b*, and with the exterior ones used in the assembly process. Two other such mounting tabs each support a conventional getter, 19, to capture gaseous impurities within envelope 11.

Access wire 15 with the first obtuse bend therein past flare 16 directing it away from the envelope length axis, is bent again at a right angle and terminated. Access wire portion 15' is welded to this terminating portion of wire 15 past this last bend therein to extend substantially parallel that axis, and further bent again in a semicircular arc to have the succeeding portion thereof extend substantially perpendicular to, and more or less cross that axis near the other end of envelope 11 opposite that end near which wire 15 is fitted into base 12.

Figure 2:
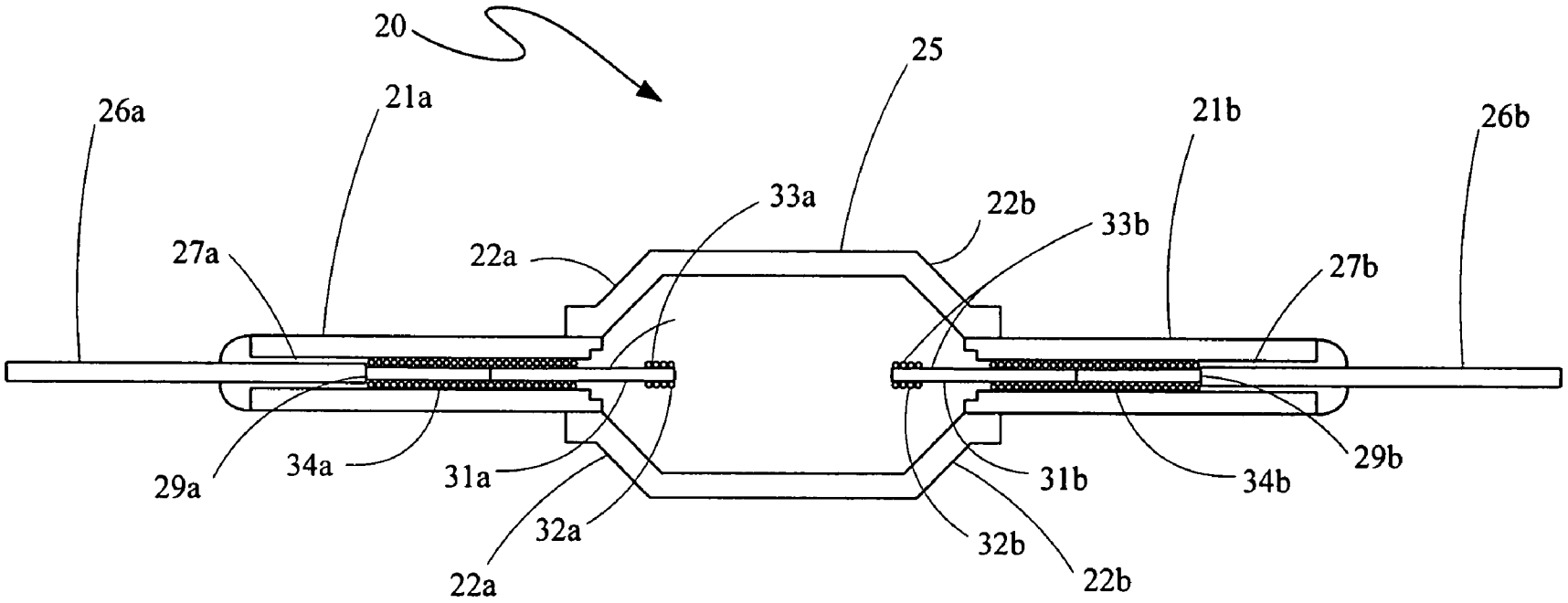
FIG. 2 shows the arc discharge chamber of FIG. 1 in cross section in an expanded side view.

A ceramic arc discharge chamber, 20, configured about a contained region as a shell structure having ceramic walls, such as polycrystalline primarily alumina walls, or primarily densely sintered $Al_2O_3$, or primarily sapphire, that are translucent to visible light, is shown in one possible configuration in FIG. 1, as positioned within shroud 18, and in more detail in FIG. 2. The region enclosed in arc discharge chamber 20 contains various ionizable materials, including metal halides of sodium, thallium, thulium, dysprosium and holmium, and also mercury, which together emit light during lamp operation and a starting gas such as the noble gases argon (Ar) or xenon (Xe). Both shroud 18, supported on support plates 17*a* and 17*b*, and discharge chamber 20 are provided within envelope 11 in a nitrogen gas atmosphere at a relatively high pressure of about 350 Torr which makes the lamp much less susceptible to catastrophic failure compared to a vacuum in envelope 11 that risks the occurrence of arcing should a slow leak develop in arc chamber 20 or envelope 11. Thus this ends supported shroud can not only stabilize the temperature about chamber 20, as indicated above, but can also provide containment of resulting debris, etc. from any explosive structural failure of that chamber to thereby protect envelope 11 from any resulting impulsive stresses that may otherwise lead to the breaking apart thereof.

Chamber 20 has a pair of relatively small inner and outer diameter ceramic truncated cylindrical shell portions, or tubes, 21*a* and 21*b*, that are shrink fitted into a corresponding one of a pair of tapered structures, 22*a* and 22*b*, about a centered hole therein at a corresponding one of the two open ends of a primary central portion chamber structure, 25, positioned therebetween. Primary chamber structure 25, formed as a truncated cylindrical shell with a diameter designated as D, has this diameter as a relatively larger diameter truncated cylindrical shell portion between the chamber ends, and chamber 20 has very short extent smaller diameter truncated cylindrical shell portion at each end thereof with a partial conical shell portion there as the tapered structure joining the smaller diameter truncated cylindrical shell portion there to the larger diameter truncated cylindrical shell portion. The wall thickness of the arc discharge chamber is chosen to be about 0.8 mm. These various portions of arc discharge tube 20 are formed by compacting alumina powder into the desired shape followed by sintering the resulting compact to thereby provide the preformed portions, and the various preformed portions are joined together by sintering to result in a preformed single body of the desired dimensions having walls impervious to the flow of gases.

Chamber electrode interconnection wires, 26*a* and 26*b*, of niobium each are axially attached by welding to a corresponding lead-through wire extending out of a corresponding one of tubes 21*a* and 21*b*. Wires 26*a* and 26*b* thereby reach and are attached by welding to, respectively, access wire 14 in the first instance at its end portion crossing the envelope length axis, and to access wire 15 in the second instance at its end portion first past the far end of chamber 20 that was originally described as crossing the envelope length axis. This arrangement results in chamber 20 being positioned and supported between these portions of access wires 14 and 15 so that its long dimension axis approximately coincides with the envelope length axis, and further allows electrical power to be provided through access wires 14 and 15 to chamber 20.

FIG. 2 is an expanded cross section view of arc discharge chamber 20 of FIG. 1 showing the discharge region therein contained within its bounding walls that are provided by primary central portion chamber shell structure 25, shell structure end portions 22*a* and 22*b*, and tubes 21*a* and 21*b* extending from ends 22*a* and 22*b*. A glass frit, 27*a*, affixes wire a molybdenum lead-through wire, 29*a*, to the inner surface of tube 21*a* (and hermetically sealing that interconnection wire opening with wire 29*a* passing therethrough). Thus, wire 29*a*, which can withstand the resulting chemical attack resulting from the forming of a plasma in the main volume of chamber 20 during operation and has a thermal expansion characteristic that relatively closely matches that of tube 21*a* and that of glass frit 27*a*, is connected to one end of interconnection wire 26*a* by welding as indicated above. The other end of lead-through wire 29*a* is connected to one end of a tungsten main electrode shaft, 31*a*, by welding.

In addition, a tungsten electrode coil, 32*a*, is integrated and mounted to the tip portion of the other end of the first main electrode shaft 31*a* by welding, so that electrode 33*a* is configured by main electrode shaft 31*a* and electrode coil 32*a*. Electrode 33*a* is formed of tungsten for good thermionic emission of electrons while withstanding relatively well the chemical attack of the metal halide plasma. Lead-through wire 29*a*, spaced from tube 21*a* by a molybdenum coil, 34*a*, serves to dispose electrode 33*a* at a predetermined position in the region contained in the main volume of arc discharge chamber 20. A typical diameter of interconnection wire 26*a* is 1.2 mm, and a typical diameter of electrode shaft 31*a* is 0.6 mm.

Similarly, in FIG. 2, a glass frit, 27*b*, affixes wire a molybdenum lead-through wire, 29*b*, to the inner surface of tube 21*b* (and hermetically sealing that interconnection wire opening with wire 29*b* passing therethrough). Thus, wire 29*b*, which can withstand the resulting chemical attack resulting from the forming of a plasma in the main volume of chamber 20 during operation and has a thermal expansion characteristic that relatively closely matches that of tube 21*b* and that of glass frit 27*b*, is connected to one end of interconnection wire 26*b* by welding as indicated above. The other end of lead-through wire 29*b* is connected to one end of a tungsten main electrode shaft, 31*b*, by welding. A tungsten electrode coil, 32*b*, is integrated and mounted to the tip portion of the other end of the first main electrode shaft 31*b* by welding, so that electrode 33*b* is configured by main electrode shaft 31*b* and electrode coil 32*b*. Lead-through wire 29*b*, spaced from tube 21*b* by a molybdenum coil, 34*b*, serves to dispose electrode 33*b* at a predetermined position in the region contained in the main volume of arc discharge chamber 20. A typical diameter of interconnection wire 26*b* is also 1.2 mm, and a typical diameter of electrode shaft 31 is again 0.6 mm. The distance between electrodes 33*a* and 33*b* is designated $L_e$, and any plane including the longitudinal axis of symmetry of the interior surface of structure 25 passes through the longitudinal centers of these electrodes.

The internal dimensions of arc discharge chamber 20 including the relative positioning of electrodes 33*a* and 33*b* therein are selected to achieve high luminous efficacy (>90 Lm/W) that can be realized in combination with good color properties (Color Rendering Index CRI or Ra>86, Correlated Color Temperature CCT~3,650 K). Such chambers configured with $L_e/D<2.75$ with D>2 mm will have these characteristics. Preferably, chambers with $L_e/D=1.00$ and D=10.7 mm are used so as to better obtain these properties.

Figure 3:
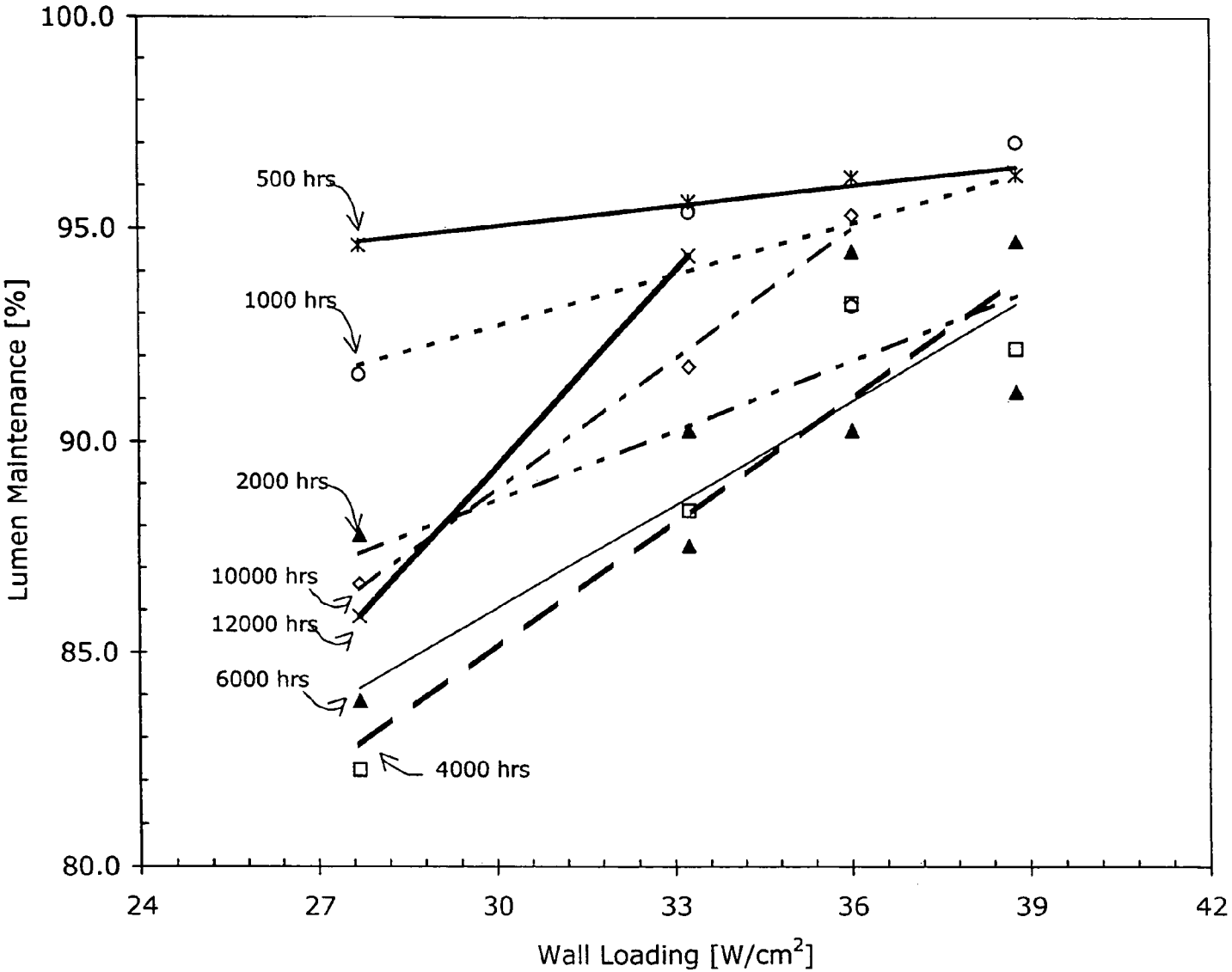
FIG. 3 is a graph showing plots, at selected lamp operational durations, of lumen value maintenance based on a reference for the lamps of FIG. 1 versus wall loadings of the included chambers of FIG. 2.

Furthermore, lamps having arc discharge chambers with wall loadings during operation equal to or greater than 33 W/cm$^2$ have been found to better maintain the initial values of their output luminous flux over the lamp operational duration. Wall loading here is defined as the quotient obtained by dividing the dissipated power of the lamp during operation by the surface area of the entire interior surface of arc discharge chamber 20 which also correlates highly with the chamber wall operating peak temperature. As is seen in FIG. 3, lumen value maintenance of the initial output luminosity over operating time in such lamps is strongly dependent on the chamber wall loading. Five groups of five lamps, each such group represented by a different data point symbol in the plots of FIG. 3, were tested over long operating time durations and measured at various intervals therein with each group operated at a corresponding one of the following wall loadings of about 28, 33, 36, 39 and 46 W/cm$^2$ chosen for that group. The lumen value maintenance, given as the fraction that the current chamber output luminosity for a lamp is of the initial (taken as 100 operating hours) chamber output luminosity for that lamp, versus wall loading has been plotted for lamps operated for 500; 1,000; 2,000; 4,000; 6,000; 10,000 and 12,000 hours. At the 100 hours initial reference point, with no plot therefor being indicated in the graph of FIG. 3, the lumen value maintenance of all lamps was taken to be 100%.

The lamp voltage $V_{1a}$ was, and is preferably chosen to be, at most 110V. Thereby, these lamps can be operated using standard electronic and magnetic ballast circuits. The electrical data found for the 33 W/cm$^2$ test group and the 28 W/cm$^2$ control group are very similar. The voltage rise for both lamp groups is about 1.50 V/1000 hours due to electrode melt back and to certain chemical changes occurring within the discharge chamber.

Thus, lumen value maintenance for these lamps was found to be favorably affected by keeping the chamber wall temperature at about 1,283 K. This is practically accomplished by choosing the wall loading at about 33 W/cm$^2$ which is easily achieved by selecting $L_e/D=1$. When increasing the ratio $L_e/D$ up to 2.75, the chamber wall temperature must be maintained at about 1283 K or more, but no greater than 1,400 K, through increasing the power consumed by the lamp by increasing the electrical current therethrough. The inside diameter D of chamber 20 should be larger than 2 mm to provide enough volume to establish a discharge arc of enough volume to generate the desired luminous flux output from the chamber.

Lamps with a wall loading of 33 W/cm$^2$ are found to have higher efficacy, better lumen value maintenance and excellent color properties. At 3,000 hours, the lamps with a wall loading of about 33 W/cm$^2$ exhibited a lumen value maintenance of about 92%. The lumen value maintenance of a control group that had a wall loading of about 28 W/cm$^2$ is 85%. At 12,000 hours, the lumen value maintenance of the 33 W/cm$^2$ lamps still exceeds 90%.

The lamps have excellent color properties and they emit white light with color point co-ordinates (x, y) along the black-body-line (BBL). At 100 hours, the 28 W/cm$^2$ and the 33 W/cm$^2$ lamps have an average correlated color temperature CCT of 3,577 K and its color point coordinates are (0.3976, 0.3790). Throughout the lamps operational duration, the change in the CCT and in coordinates (x, y) of both groups are very similar to one another.

Knowing that the service life of metal halide lamps depends on the wall loading of the discharge chamber used therein, the higher wall loading of 33 W/cm$^2$ was found not to have compromised the operational duration of the lamps. Extensive life testing demonstrated that the operational durations of these lamps was more than 14,000 hours. There were no failures recorded at 14,000 hours of operation.

Although the chemical reactions that occur at the ceramic arc tube wall are not well understood, a wall loading of 33 W/cm$^2$ appears to release free oxygen from the arc discharge chamber wall into the discharge during the operation of such lamps as indicated above. Such free oxygen is released under the influence of chemical reactions occurring with the constituents enclosed in the chamber.

A small amount of oxygen appears to be needed to maintain the tungsten halogen cycle in the lamp described above when the lamp is in operation. The result of an efficient halogen cycle is the diminishment of wall blackening and an improvement in lumen value maintenance.

Arc discharge chambers with wall loadings equal to or greater than 33 W/cm$^2$ appear to have more wall reactions resulting in greater removal and transport of ceramic arc discharge chamber structural material. Especially, the areas where the salts reside exhibit extensive corrosion. Using spectroscopic measurements, $AlI_3$ was found to be formed near the wall and apparently free oxygen is being released there into the discharge reactions.

Moreover, the ceramic arc discharge chamber structural material, polycrystalline primarily alumina walls as stated above, in particular, $Al_2O_3$, may be an integral part of the lamp chemistry. Hence, during lamp operation, free oxygen is generated from the chamber wall and released to the discharge reactions. Ceramic chamber metal halide lamps operated with a wall loading of 33 W/cm$^2$, or higher, appear to generate sufficient free oxygen to favorably influence the tungsten halogen cycle. Consequently, during lamp operation, tungsten deposited on the chamber wall is removed and transported back to the electrodes keeping the walls very clean. The regenerative cycle prevents the deterioration of the bulb wall transmission resulting in higher lumen value maintenance and a longer operational duration for the lamp.

In greater detail in connection with the above chamber wall loading comparison, 25 lamps 10 of FIG. 1 were made with the arc discharge chamber 20 therein each provided in the contained region thereof with the same iodide salt constituents of NaI, $DyI_3$, $HoI_3$, $TmI_3$ and T1I. At a 100 hours of lamp operation initial testing, the average luminous efficacy and correlated color temperature CCT of these lamps were 88 lm/W and 3,592 K, respectively, and the average color point coordinates were (0.3974, 0.3801). The average general color-rendering index Ra or CRI was about 87. The average operating voltage maintained across these lamps was 91 Volts.

Five groups of these lamps 10 each having therein such an arc discharge chambers 20 were operated with each such group having a corresponding one of the following wall loadings of about 28, 33, 36, 39 and 46 W/cm$^2$ maintained in the lamps of that group during operation to measure lamp performance over various operational durations. Either magnetic or electronic ballast circuits are suitable to operate the lamps for this purpose. During this testing, photometry and electrical data were recorded at 100; 250; 500; 750; 1,000; 1,500; 2,000; 3,000 hours of operation, etc. as the basis for the tables below. The lumen value maintenance was calculated for each lamp from this data and compared for the different groups. In addition, visual inspection of these lamps was performed periodically to estimate the degree of blackening of the arc discharge chambers involved at these different operational durations.

TABLE I

| Hours | W/cm$^2$ | $V_{lamp}$ | Lm/W | Maintenance [%] | CCT | CRI |
|---|---|---|---|---|---|---|
| 100 | 28 W/cm$^2$ | 89 | 90 | 100% | 3546 | 87 |
| 1000 | | 90 | 82 | 92 | 3580 | 88 |
| 3000 | | 88 | 76 | 85 | 3602 | 88 |
| 6000 | | 92 | 76 | 84 | 3828 | 90 |
| 9000 | | 99 | 76 | 84 | 4308 | 90 |
| 12000 | | 104 | 78 | 86 | 3936 | 90 |

TABLE II

| Hours | W/cm$^2$ | $V_{lamp}$ | Lm/W | Maintenance [%] | CCT | CRI |
|---|---|---|---|---|---|---|
| 100 | 33 W/cm$^2$ | 89 | 90 | 100% | 3654 | 86 |
| 1000 | | 89 | 85 | 95 | 3628 | 87 |
| 3000 | | 92 | 82 | 92 | 4053 | 89 |
| 6000 | | 94 | 78 | 88 | 4053 | 89 |
| 9000 | | 99 | 82 | 91 | 4390 | 86 |
| 12000 | | 110 | 84 | 94 | 4217 | 88 |

The typical results for lamps in two of these groups, those operated with a wall loading of 28 W/cm$^2$ in lamps dissipating during operation 150 Watts, and those operated with a wall loading of 33 W/cm$^2$ in lamps dissipating during operation 180 Watts, are summarized in Table I and Table II, respectively. The data presented there is the average of the corresponding five lamps forming each of these two groups. After 3,000 hours of operation, the lumen value maintenance of the lamps with a wall loading of 33 W/cm$^2$ is on the average 7% greater than that of the lamps with a wall loading of 28 W/cm$^2$. At 12,000 hours, the lumen value maintenance of the 33 W/cm$^2$ lamps still exceeds 90%. The arc discharge chambers of this latter group appear to be less blackened, and thus more transparent, in comparison with the lamps of the 28 W/cm$^2$ group.

Figure 4:
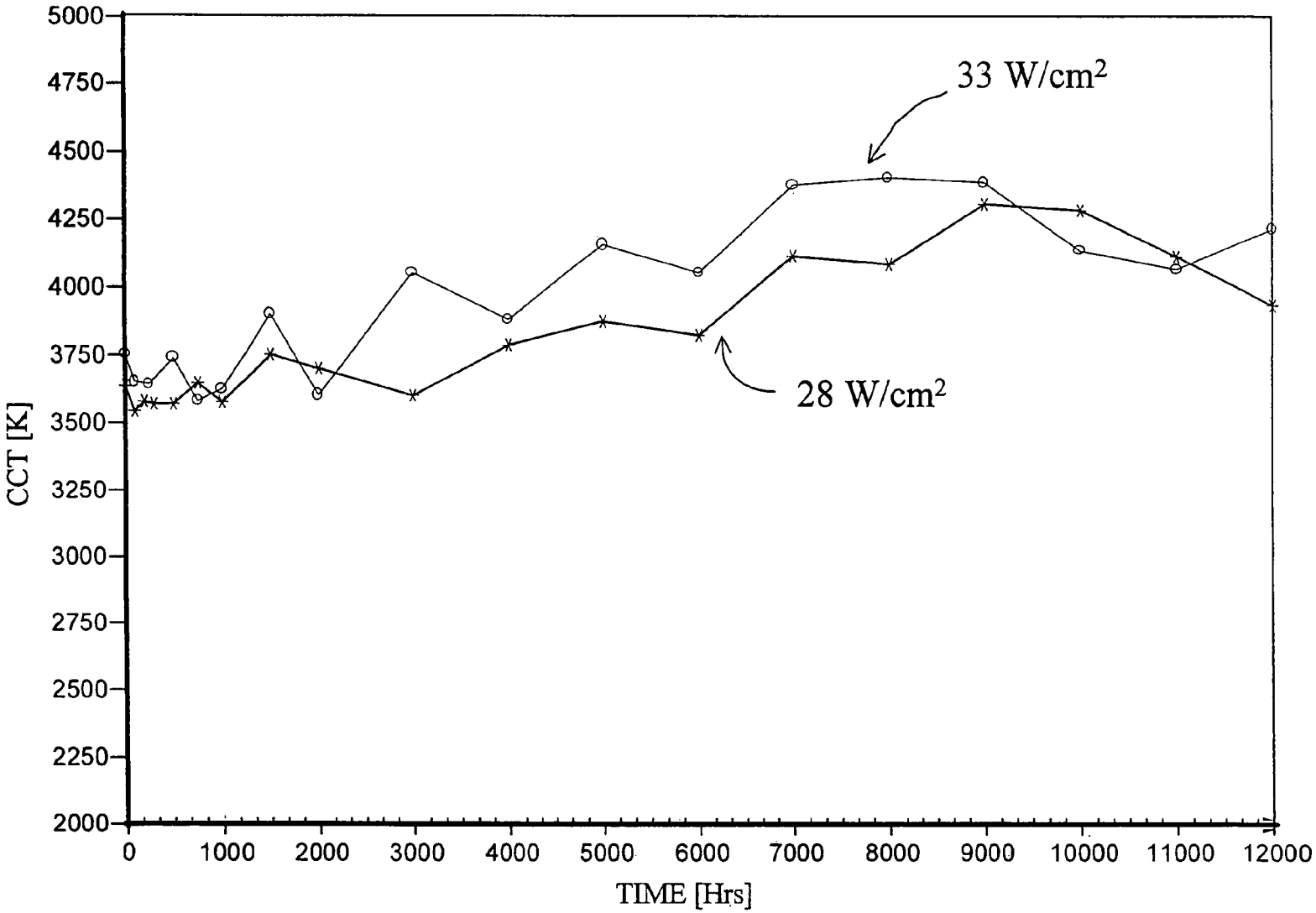
FIG. 4 is a graph showing plots of correlated color temperature over lamp operational duration for two groups of lamps of FIG. 1 each operated at a corresponding one of a pair of selected operating wall loadings of the included chambers of FIG. 2.
Figure 5:
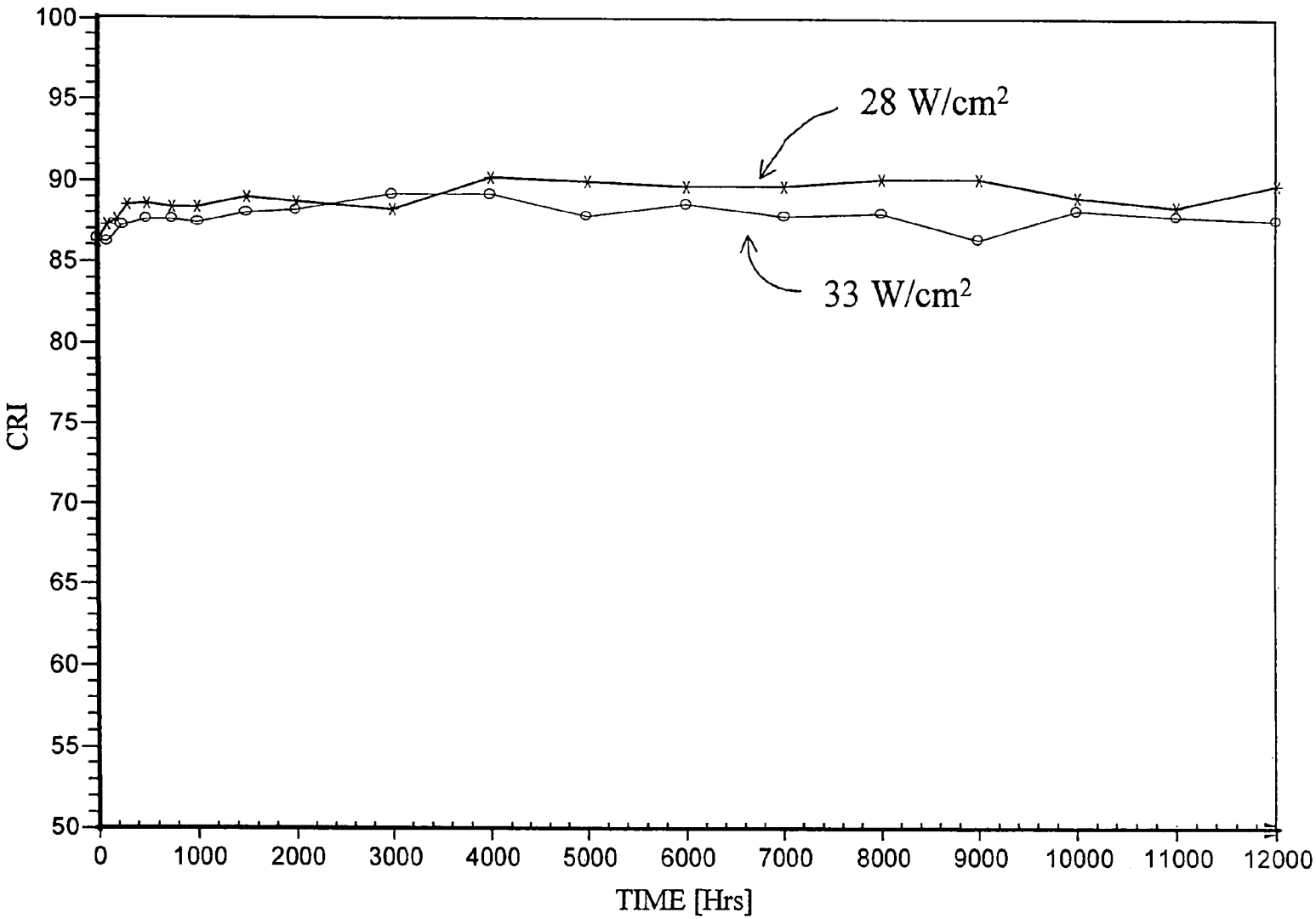
FIG. 5 is a graph showing plots of a color rendering index over lamp operational duration for two groups of lamps of FIG. 1 each operated at a corresponding one of a pair of selected operating wall loadings of the included chambers of FIG. 2.

The lamps in both groups have excellent color properties, and the change of color coordinated temperature CCT of each group shown in FIG. 4 and the change of the color rendering index CRI shown in FIG. 5 over the operational duration of the lamps is similar. The lamps maintained a general color-rendering index value Ra>86 and a correlated color temperature CCT of about 3,500 K during at least 12,000 hours of lamp operation. Hence, these lamps are very suitable to be used as a light source for indoor lighting.

Figure 6:
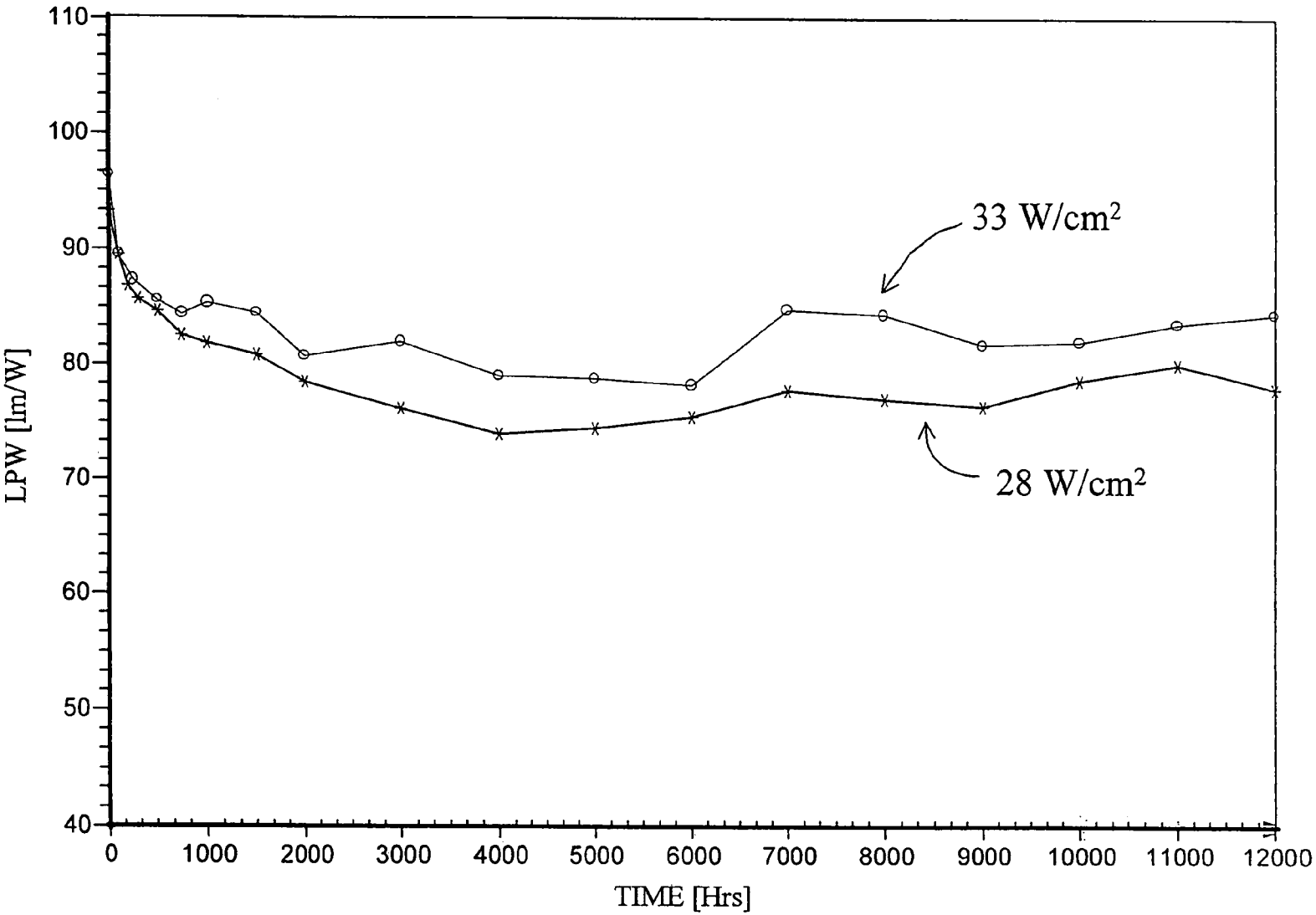
FIG. 6 is a graph showing plots of luminous efficacy over lamp operational duration for two groups of lamps of FIG. 1 each operated at a corresponding one of a pair of selected operating wall loadings of the included chambers of FIG. 2.
Figure 7:
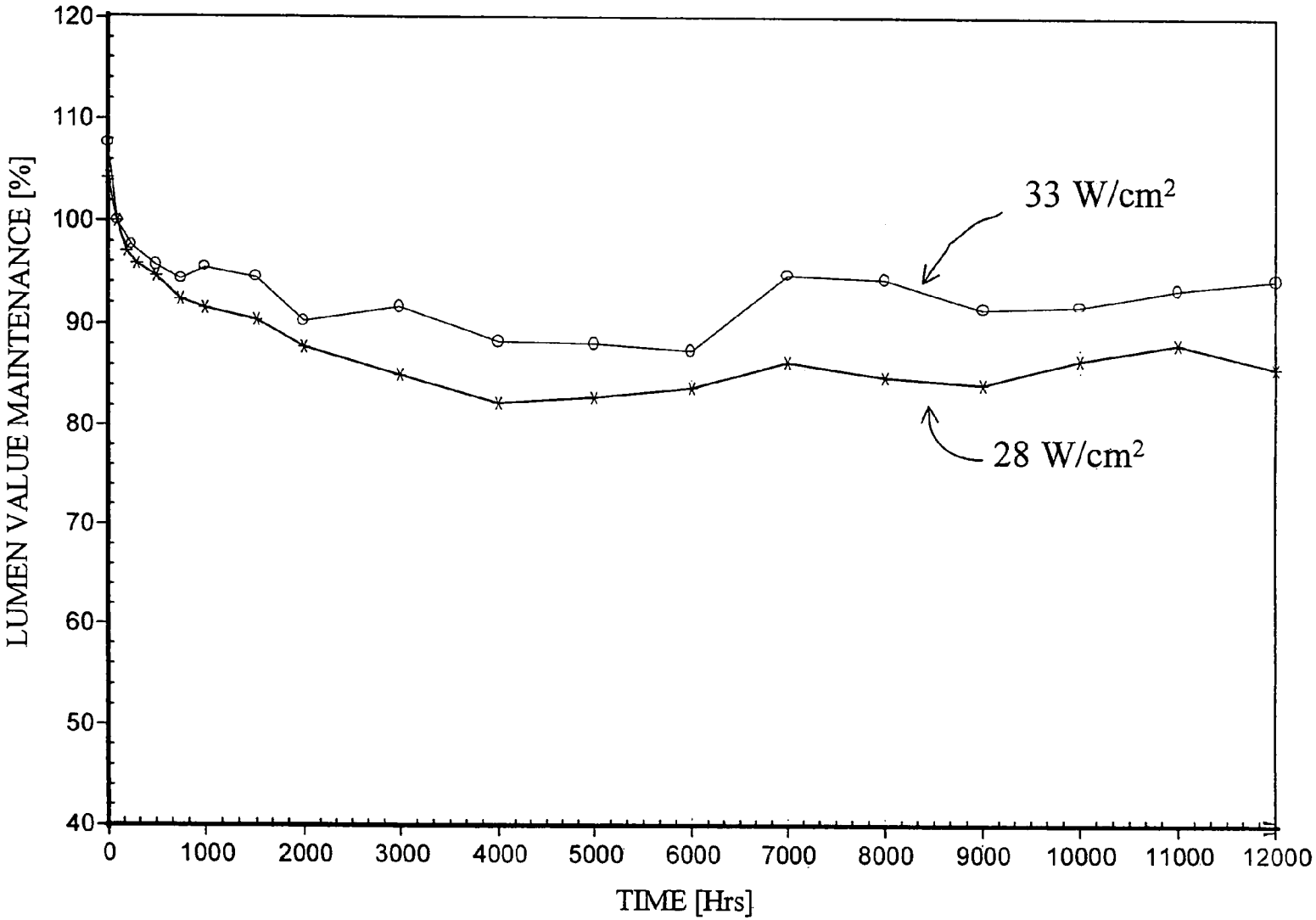
FIG. 7 is a graph showing plots of lumen value maintenance over lamp operational duration for two groups of lamps of FIG. 1 each operated at a corresponding one of a pair of selected operating wall loadings of the included chambers of FIG. 2.
Figure 8:
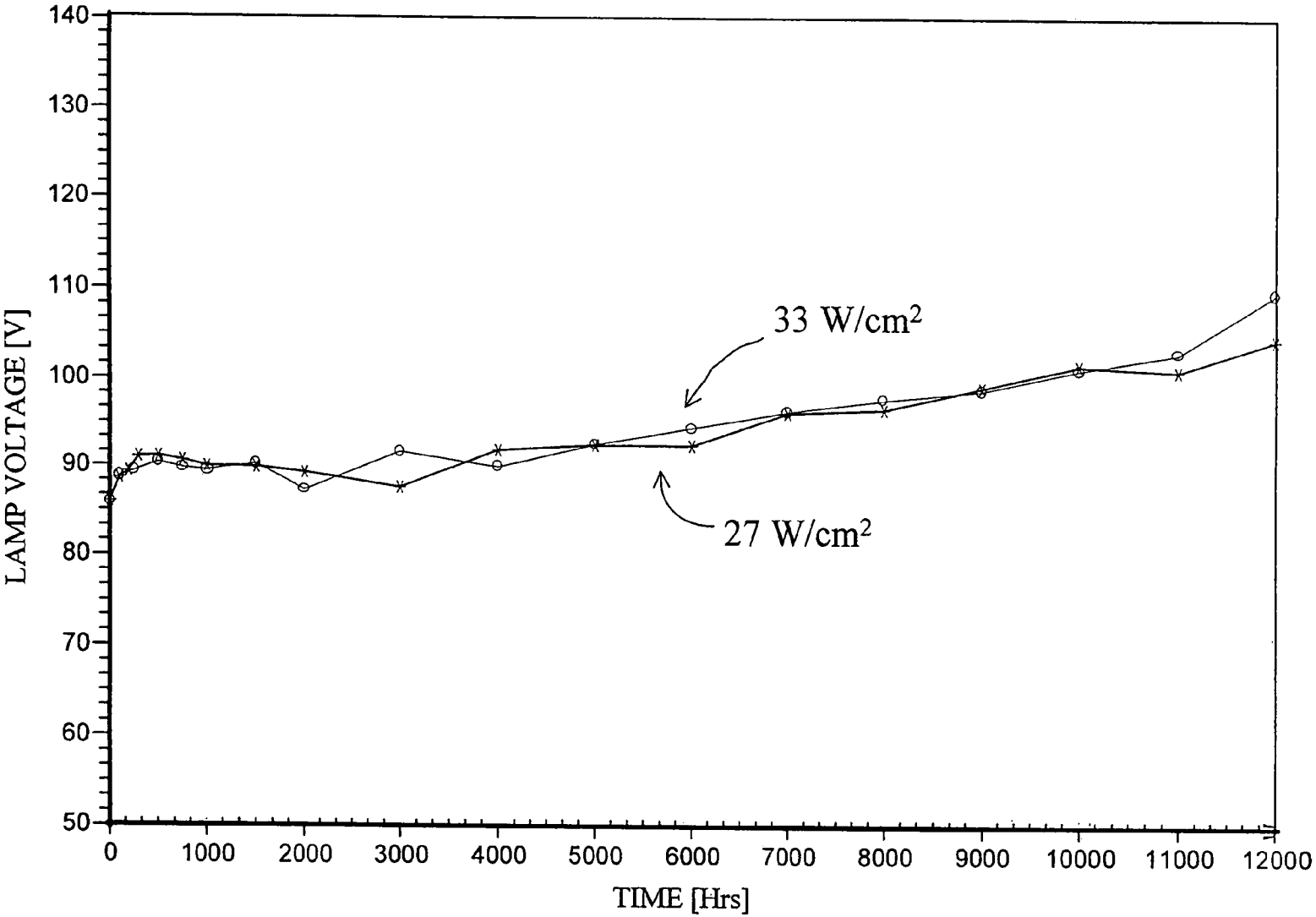
FIG. 8 is a graph showing plots of lamp operating voltage over lamp operational duration for two groups of lamps of FIG. 1 each operated at a corresponding one of a pair of selected operating wall loadings of the included chambers of FIG. 2.

FIG. 6 shows the luminous efficacy of the lamps in the group with a wall loading of 28 W/cm$^2$ and those in the group with a wall loading of 33 W/cm$^2$ as a function of lamp operational duration. Most of the changes in this efficacy happen during the first 3,000 lamp operating hours. From Table I and Table II, at 3,000 hours of operation, the efficacy of the 33 W/cm$^2$ wall loading group of lamps is 82 lm/W as compared to the 76 lm/W for the 28 W/cm$^2$ wall loading group of lamps. Thus, the lumen value maintenance shown in FIG. 7 for these two groups of lamps has been influenced favorably by choosing to operate the one group with the wall loading thereof set at about 33 W/cm$^2$ in comparison with the other group. FIG. 8 shows that the increase in operating voltage across the lamps over lamp operational duration for the group of lamps operated with a wall loading of 33 W/cm$^2$ is similar to that of the group of lamps operated with a wall loading of 28 W/cm$^2$. The operating voltage rise for both lamp groups is about 1.50 V/1000 operating hours thus indicating minimal chemical changes occurring inside the arc discharge chambers over long operational durations.

The testing also showed that those two groups of lamps operated with wall loadings correspondingly of about 36 W/cm$^2$ and of about 46 W/cm$^2$ likewise exhibit better lumen value maintenance than does the group operated at the wall loading of 28 W/cm$^2$. Table III shows the lamp operating voltage, luminous efficacy, lumen value maintenance, correlated color temperature CCT and the color rendering index CRI versus operational duration for the group of lamps operated with a wall loading of 39 W/cm$^2$. From the data shown in Tables I and II, the luminous efficacy and the lumen value maintenance improves gradually as the operating wall loading of the lamps is increased.

TABLE III

| Hours | W/cm$^2$ | $V_{lamp}$ | Lm/W | Maintenance [%] | CCT | CRI |
|---|---|---|---|---|---|---|
| 100 | 39 W/cm$^2$ | 95 | 87 | 100% | 3531 | 86 |
| 1000 | | 97 | 85 | 97 | 3681 | 89 |
| 3000 | | 98 | 83 | 95 | 3697 | 89 |
| 6000 | | 102 | 79 | 91 | 3899 | 89 |

However, the groups of lamps operated with wall loadings higher than 33 W/cm$^2$ such as 36, 39 and 46 W/cm$^2$ were found to suffer somewhat enhanced chemical attacking of the ceramic wall of the arc discharge chamber that can lead to an increased operating voltage across the lamps and so to a reduction of the operational duration of the lamps in service. In particular, the group of lamps operated with a wall loading of 46 W/cm$^2$ showed increased chemical erosion of the wall in the area thereof where the salts are deposited. In addition, these lamps have steeper lamp operating voltage rise over the operational duration thereof due to the chemical changes occurring inside the arc discharge chambers therein and to the electrode damage.

Bearing in mind the service duration of these lamps depends upon the wall loading of the arc discharge chambers therein, a greater wall loading of about 33 W/cm$^2$ seems not to compromise the operational duration of the lamp in service. Extensive life testing demonstrated that the operational duration of these lamps was more than 14,000 operating hours. Furthermore, there were no lamp failures recorded in 14,000 operating hours.

Thus, the wall loading of the arc discharge chamber in the lamp during operation thereof should be chosen to be about 33 W/cm$^2$ or somewhat more. Thereby, these lamps are suitable for being operated in existing fixtures used for operating metal halide lamps. In such an arrangement, the metal halide lamps described above can be provided having a long lifetime, good color rendering, high efficacy and excellent lumen value maintenance. Especially, such lamps, operated with a wall loading of around 33 W/cm$^2$, combine high luminous flux, improved lumen value maintenance, good color properties and excellent lamp operational duration.

Although the present invention has been described with reference to preferred embodiments, workers skilled in the art will recognize that changes may be made in form and detail without departing from the spirit and scope of the invention.

The invention claimed is:

1. An arc discharge metal halide lamp for use in selected lighting fixtures, said lamp comprising:

a discharge chamber having visible light permeable walls of a selected shape bounding a discharge region through which walls a pair of electrodes are supported in said discharge region spaced apart from one another by a distance $L_e$ with said walls about said discharge region having an average diameter over $L_e$ equal to D so as to satisfy $L_e/D<2.75$ with D exceeding 2.0 mm; and ionizable materials provided in said discharge region of said discharge chamber comprising a noble gas, a metal halide and mercury in an amount sufficiently small to result in a voltage drop between said electrodes during lamp operation that is less than 110 V rms at a selected value of electrical power dissipation in said lamp such that wall loading of said discharge chamber during operation equals or exceeds 33 W/cm$^2$.

2. The device of claim 1 wherein said walls of said discharge chamber comprise a metal oxide material.

3. The device of claim 1 wherein said wall loading of said discharge chamber during operation is between 33 W/cm$^2$ and 46 W/cm$^2$.

4. The device of claim 1 wherein said metal halide comprises one of a group of Na, Tl, Al, Mg, Ca, Li, Ga and selected rare earths in a halide compound.

5. The device of claim 2 wherein said walls of said discharge chamber are approximately 0.8 mm thick at locations across from where said pair of electrodes are spaced apart from one another.

6. The device of claim 2 wherein said metal oxide material comprises one of the group sapphire or densely sintered aluminum oxide.

7. The device of claim 3 wherein said walls of said discharge chamber have a maximum temperature between 1,250 K and 1,400 K.

8. The device of claim 4 wherein said rare earths are one of a group of Dy, Tm, Ho, Sc, Lu, Eu, Nd, Pr, Ce, Gd, Th, and Sm.

9. The device of claim 4 wherein said metal halide is one of a plurality of metal halides in said discharge space.

10. The device of claim 4 wherein any of said rare earths in a said halide compound are in an iodide compound.

11. An arc discharge metal halide lamp for use in selected lighting fixtures, said lamp comprising:

a discharge chamber having visible light permeable walls of a selected shape comprising a metal oxide and bounding a discharge region through which walls a pair of electrodes are supported in said discharge region spaced apart from one another; and ionizable materials provided in said discharge region of said discharge chamber comprising a noble gas, a metal halide and mercury so that said lamp can be operated at selected values of electrical power dissipation therein that result in wall loadings of said discharge chamber during operation sufficient to maintain output luminosity of said discharge chamber after 12,000 hours of lamp operation at ninety percent or more of that output luminosity said discharge chamber provided during lamp operation at 100 hours of lamp operation.

12. The device of claim 11 wherein said pair of electrodes supported in said discharge region are spaced apart from one another by a distance $L_e$ with said walls about said discharge region having an average diameter along $L_e$ equal to D so as to satisfy $L_e/D<2.75$ with D exceeding 2.0 mm.

13. The device of claim 11 wherein said walls of said discharge chamber are approximately 0.8 mm thick at locations across from where said pair of electrodes are spaced apart from one another.

14. The device of claim 11 wherein said metal oxide material comprises one of the group sapphire or densely sintered aluminum oxide.

15. The device of claim 11 wherein said walls of said discharge chamber have a maximum temperature between 1,250 K and 1,400 K.

16. The device of claim 11 wherein said metal halide comprises one of a group of Na, Tl, Al, Mg, Ca, Li, Ga and selected rare earths in a halide compound.

17. The device of claim 16 wherein said rare earths are one of a group of Dy, Tm, Ho, Sc, Lu, Eu, Nd, Pr, Ce, Gd, Th, and Sm.

18. The device of claim 16 wherein said metal halide is one of a plurality of metal halides in said discharge space.

19. The device of claim 16 wherein any of said rare earths in a said halide compound are in an iodide compound.

* * * * *